US008701644B2

(12) United States Patent
McPherson

(10) Patent No.: US 8,701,644 B2
(45) Date of Patent: Apr. 22, 2014

(54) BOW LIMB RETAINING SYSTEM

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 13/909,663

(22) Filed: Jun. 4, 2013

(65) Prior Publication Data

US 2013/0269672 A1 Oct. 17, 2013

Related U.S. Application Data

(63) Continuation of application No. 12/916,261, filed on Oct. 29, 2010, now Pat. No. 8,453,635.

(60) Provisional application No. 61/256,844, filed on Oct. 30, 2009.

(51) Int. Cl.

| | |
|---|---|
| ***F41B 5/10*** | (2006.01) |
| ***F41B 5/14*** | (2006.01) |
| ***F41B 5/00*** | (2006.01) |

(52) U.S. Cl.

CPC ..... *F41B 5/10* (2013.01); *F41B 5/0026* (2013.01); *F41B 5/14* (2013.01)

USPC ..... 124/88; 124/23.1; 124/25; 124/25.6; 124/86

(58) Field of Classification Search

CPC ..... F41B 5/10; F41B 5/0026; F41B 5/14

USPC ..... 124/23.1, 25, 25.6, 86, 88

See application file for complete search history.

(56) References Cited

U.S. PATENT DOCUMENTS

| | | | | | |
|---|---|---|---|---|---|
| 480,879 | A | | 8/1892 | Stevenson | |
| RE13,844 | E | | 12/1914 | Sawyer | |
| 1,371,619 | A | | 3/1921 | Greenstreet | |
| 3,161,189 | A | | 12/1964 | Chessman | |
| 3,486,495 | A | * | 12/1969 | Allen | 124/25.6 |
| 4,178,905 | A | * | 12/1979 | Groner | 124/25.6 |
| 4,261,320 | A | * | 4/1981 | Barna | 124/25.6 |
| 4,574,766 | A | * | 3/1986 | Izuta | 124/23.1 |
| 4,644,929 | A | * | 2/1987 | Peck | 124/23.1 |
| 4,674,468 | A | * | 6/1987 | Izuta | 124/23.1 |
| 5,025,774 | A | * | 6/1991 | Martin | 124/89 |
| 5,099,819 | A | * | 3/1992 | Simonds et al. | 124/23.1 |
| 5,172,679 | A | * | 12/1992 | Mussack | 124/25.6 |
| 5,231,970 | A | * | 8/1993 | Ploot et al. | 124/23.1 |

(Continued)

OTHER PUBLICATIONS

U.S. Appl. No. 61/256,844, filed Oct. 30, 2009; Inventor: Mathew A. McPherson.

*Primary Examiner* — Gene Kim

*Assistant Examiner* — Alexander Niconovich

(74) *Attorney, Agent, or Firm* — Vidas, Arrett & Steinkraus

(57) ABSTRACT

A bow limb retaining assembly comprises a limb and a retainer having a cavity for receiving the limb. The retainer comprises opposed lateral surfaces, a first abutting surface arranged to contact a compression surface of the limb and a second abutting surface arranged to contact a tension surface of the limb. A first length portion of the retainer includes the first abutting surface and excludes the second abutting surface, and a second length portion of the retainer includes the second abutting surface and excludes the first abutting surface.

20 Claims, 10 Drawing Sheets

(56) References Cited

U.S. PATENT DOCUMENTS

| | | | | | |
|---|---|---|---|---|---|
| 5,280,779 | A * | 1/1994 | Smith | 124/88 |
| 5,339,790 | A * | 8/1994 | Smith | 124/25.6 |
| 5,368,006 | A | 11/1994 | McPherson | |
| 5,377,658 | A * | 1/1995 | Shepley, Jr. | 124/88 |
| 5,408,982 | A * | 4/1995 | Doornenbal | 124/23.1 |
| 5,411,008 | A * | 5/1995 | Hsu | 124/23.1 |
| 5,429,106 | A * | 7/1995 | Martin et al. | 124/23.1 |
| 5,433,792 | A * | 7/1995 | Darlington | 124/25.6 |
| 5,464,001 | A * | 11/1995 | Peck | 124/25.6 |
| 5,487,373 | A * | 1/1996 | Smith | 124/23.1 |
| 5,507,270 | A * | 4/1996 | Smith | 124/23.1 |
| 5,515,836 | A * | 5/1996 | Martin et al. | 124/23.1 |
| 5,546,923 | A | 8/1996 | Duncan | |
| 5,592,929 | A * | 1/1997 | Hoyt, Jr. | 124/23.1 |
| 5,660,158 | A * | 8/1997 | Rudolph | 124/23.1 |
| 5,697,355 | A * | 12/1997 | Schaffer | 124/25.6 |
| 5,697,358 | A * | 12/1997 | Campisi | 124/88 |
| 5,720,267 | A * | 2/1998 | Walk | 124/23.1 |
| 5,722,380 | A * | 3/1998 | Land et al. | 124/25.6 |
| 5,947,099 | A * | 9/1999 | Derus | 124/25.6 |
| 6,024,076 | A * | 2/2000 | Laborde et al. | 124/23.1 |
| 6,244,259 | B1 * | 6/2001 | Adkins | 124/23.1 |
| 6,257,220 | B1 | 7/2001 | McPherson et al. | |
| 6,267,108 | B1 | 7/2001 | McPherson et al. | |
| 6,360,734 | B1 * | 3/2002 | Andrews | 124/23.1 |
| 6,371,098 | B1 | 4/2002 | Winther | |
| 6,470,870 | B1 | 10/2002 | Schaar | |
| 6,543,432 | B2 * | 4/2003 | Andrews et al. | 124/23.1 |
| 6,571,785 | B1 * | 6/2003 | Choma | 124/25 |
| 6,712,057 | B2 * | 3/2004 | Andrews | 124/23.1 |
| 6,786,214 | B2 | 9/2004 | Andrews | |
| 6,886,549 | B2 * | 5/2005 | McPherson | 124/23.1 |
| 6,941,937 | B2 * | 9/2005 | Wheeler | 124/23.1 |
| 6,964,271 | B2 | 11/2005 | Andrews | |
| 7,025,051 | B1 * | 4/2006 | Gallops, Jr. | 124/23.1 |
| 7,077,116 | B1 * | 7/2006 | Darlington | 124/23.1 |
| 7,308,890 | B1 * | 12/2007 | Wheeler | 124/23.1 |
| 7,334,575 | B2 * | 2/2008 | McPherson | 124/23.1 |
| 7,584,750 | B2 * | 9/2009 | Chang | 124/25 |
| 7,918,218 | B1 * | 4/2011 | Kronengold et al. | 124/23.1 |
| 8,047,189 | B2 * | 11/2011 | McPherson | 124/23.1 |
| 8,069,847 | B2 * | 12/2011 | Blosser | 124/25.6 |
| 2003/0084893 | A1 * | 5/2003 | Andrews | 124/23.1 |
| 2004/0077440 | A1 * | 4/2004 | Kronfeld | 473/578 |
| 2008/0072888 | A1 | 3/2008 | Chang | |
| 2008/0127961 | A1 * | 6/2008 | McPherson | 124/88 |
| 2008/0156310 | A1 | 7/2008 | Leven | |
| 2008/0236557 | A1 | 10/2008 | Budd | |
| 2009/0071457 | A1 | 3/2009 | Gordon et al. | |
| 2009/0071458 | A1 | 3/2009 | Gordon et al. | |
| 2009/0145411 | A1 * | 6/2009 | Sims et al. | 124/25.6 |
| 2009/0241928 | A1 * | 10/2009 | Blosser | 124/25.6 |
| 2010/0263650 | A1 * | 10/2010 | Dahl et al. | 124/25.6 |

* cited by examiner

BOW LIMB RETAINING SYSTEM

CROSS-REFERENCE TO RELATED APPLICATIONS

This application is a continuation of U.S. patent application Ser. No. 12/916,261, filed Oct. 29, 2010, now U.S. Pat. No. 8,453,635, which claims the benefit of U.S. Provisional Patent Application No. 61/256,844, filed Oct. 30, 2009, the entire disclosures of which are hereby incorporated herein by reference

BACKGROUND OF THE INVENTION

This invention relates to an archery bow and more specifically a system for retaining archery bow limbs.

All US patents and applications and all other published documents mentioned anywhere in this application are incorporated herein by reference in their entirety.

Prior art archery bows are known to have bow limbs anchored to a bow handle. In many cases, these archery bows use a limb pocket to attach the bow limbs to the bow handle. In order to retain a limb in the limb pocket, known limb pockets sandwich a portion of the bow limb between a floor of the limb pocket and an opposing ceiling. Alternatively, known limb pockets sandwich a limb between the floor of the limb pocket and the head of a threaded bolt.

These prior art limb pockets and limbs have a number of disadvantages. For example, removal of the limb can be difficult, and may include first removing a number of other components, including bolts, washers, spacers, and alignment plates. Another disadvantage is the manner in which prior art limbs are secured to the bow handle. For example, the "sandwiched limbs" of the prior art utilize a bolt that is placed in an undesirable single-shear condition.

In light of these and other disadvantages found in prior art archery bows, there remains a need for improved limb retainers.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a limb retainer comprises first and second surfaces and shaped sidewall portions. A limb comprises shaped sidewall portions configured to engage the sidewall portions of the limb retainer to prevent longitudinal movement of the limb. The limb is received in the limb retainer such that one of the surfaces abuts a compression side of the limb and the other surface abuts a tension side of the limb. The first and second surfaces provide forces that counteract forces applied to a distal end of the limb, such as forces applied by a bowstring.

In some embodiments, a bow limb retaining assembly comprises a limb and a retainer having a cavity for receiving the limb. The retainer comprises a first lateral surface and a second lateral surface opposed to the first lateral surface. The first lateral surface comprising an interlocking portion and the second lateral surface comprising an interlocking portion.

The bow limb has a tension surface, a compression surface and first and second outer sides. The first outer side comprises a first limb interlocking portion and the second outer side comprises a second limb interlocking portion. The first lateral surface interlocking portion is configured to matingly engage the first limb interlocking portion. The second lateral surface interlocking portion configured to matingly engaged the second limb interlocking portion.

In some embodiments, a bow limb retaining assembly comprises a limb and a retainer having a cavity for receiving the limb. The retainer comprises opposed lateral surfaces, a first abutting surface arranged to contact a compression surface of the limb and a second abutting surface arranged to contact a tension surface of the limb. A first length portion of the retainer includes the first abutting surface and excludes the second abutting surface, and a second length portion of the retainer includes the second abutting surface and excludes the first abutting surface.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE INVENTION

A detailed description of the invention is hereafter described with specific reference being made to the drawings.

DETAILED DESCRIPTION OF THE INVENTION

Figure 1:
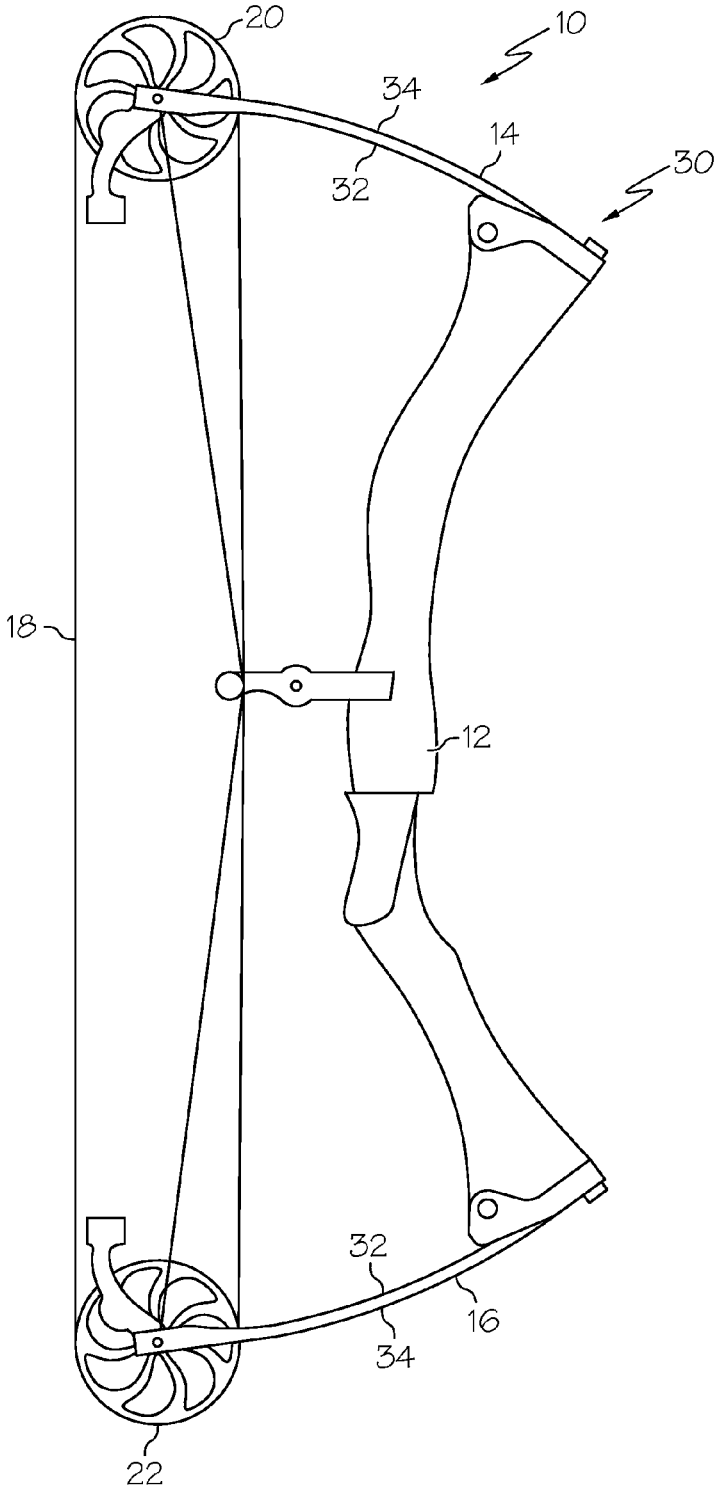
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10 comprising a limb retaining assembly 30. The retaining assembly 30 retains a limb 14, securing it to a bow handle 12.

An archery bow 10 comprises a riser or handle 12, a first limb 14 and a second limb 16. In some embodiments, each limb 14, 16 supports a respective rotatable member 20, 22, for example where the bow is a compound bow. In some embodiments, each rotatable member 20, 22 can comprise a cam or pulley.

The archery bow 10 further comprises a bowstring 18. The bowstring 18 extends between the first and second limbs 14, 16 and, in some embodiments, engages rotatable members 20, 22, for example as in a compound archery bow. In some embodiments, the bowstring extends between first and second limbs for attachment to the limbs, for example in a recurve archery bow (not shown).

Each limb 14, 16 has a compression surface 32 and a tension surface 34. The compression surface 32 of a first limb 14 faces the compression surface 32 of the second limb 16, while the tension surfaces 34 of the first and second limbs 14, 16 face outwardly away from each other.

Figure 2:
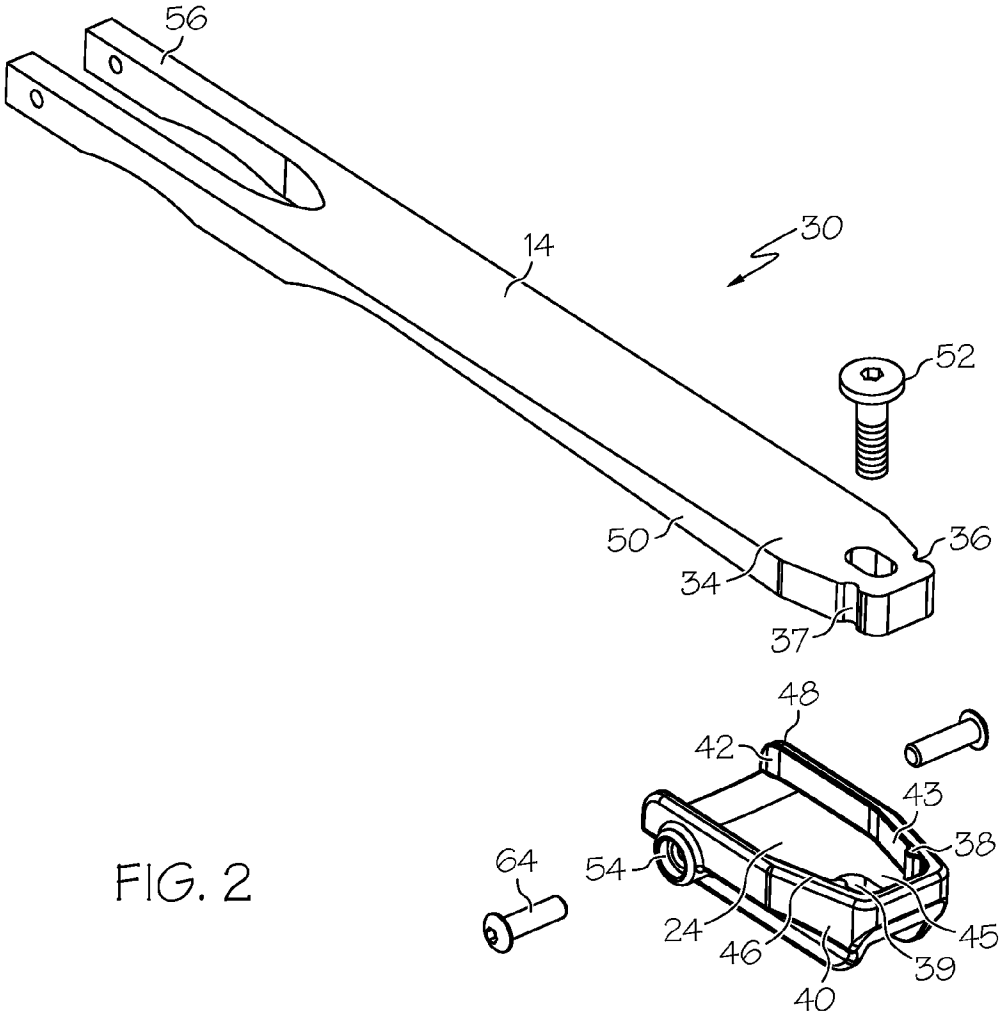
FIG. 2 shows an embodiment of an assembly comprising a limb retainer and a limb.
Figure 3:
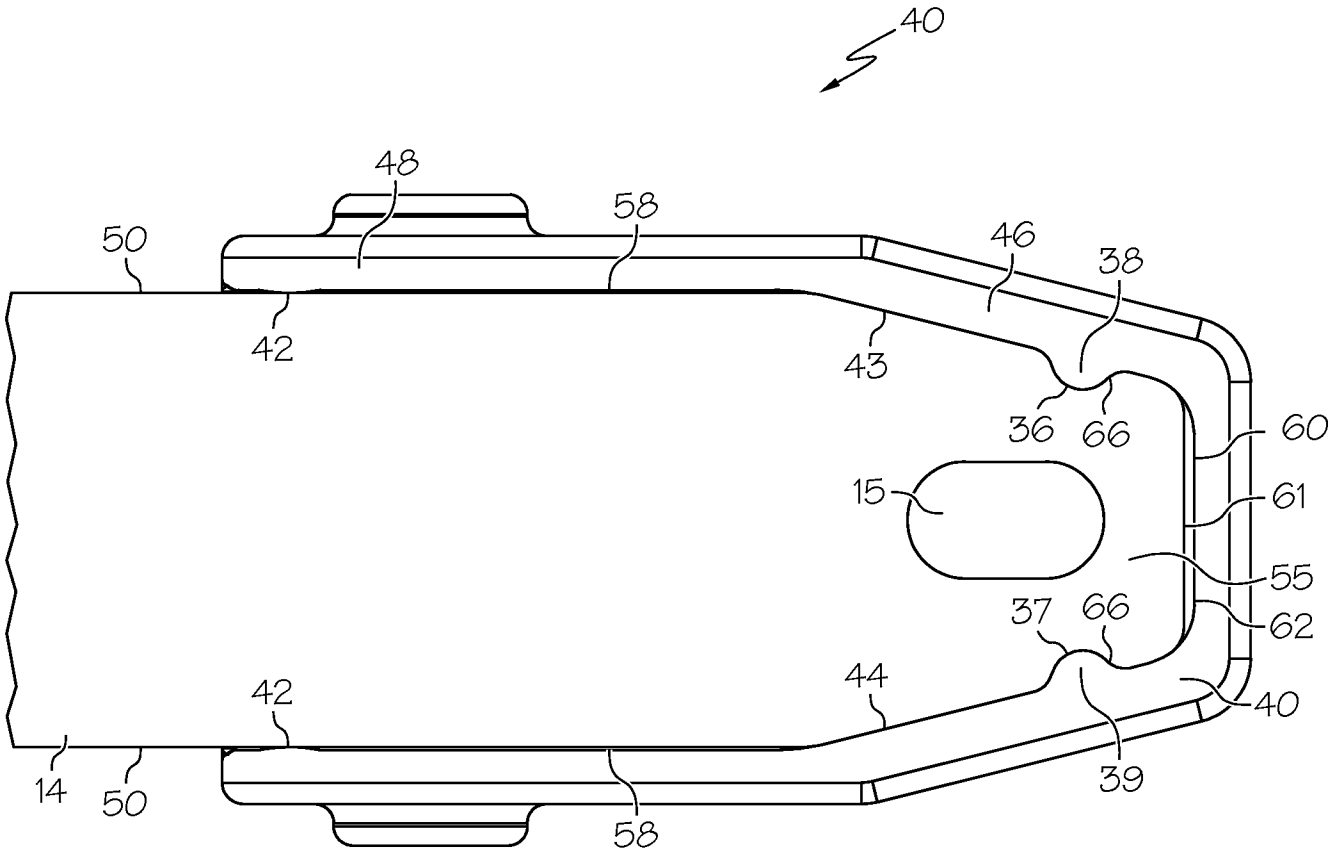
FIG. 3 shows another view of a limb retainer and a limb.

Turning to FIG. 2, an embodiment of a limb retaining assembly 30 is shown in an exploded view. In some embodiments, the limb retaining system 30 comprises a limb retainer 40 and a first bow limb 14. The limb retainer 40 comprises a first limb pocket 45. The first limb pocket 45 comprises a first lateral surface 43 and a second lateral surface 44 opposite the first lateral surface 43 (FIG. 3). The first limb pocket 45 further comprises an abutting surface 24. The first abutting surface 24 adjoins at least a portion of the first lateral surface 43 and the second lateral surface 44. In some embodiments, the first and second lateral surfaces 43, 44 are perpendicular to at least a portion of the abutting surface 24. In some embodiments, the first and second lateral surfaces 43, 44 form a V-shape, for example as disclosed in U.S. Pat. No. 6,886,549, the entire disclosure of which is hereby incorporated herein by reference.

In some embodiments, the first lateral surface 43 comprises a first interlocking portion 38. In some embodiments, the first interlocking portion 38 comprises a protrusion extending into the limb cavity and outwardly from the first lateral surface 43. The first interlocking portion 38 can also comprise any other suitable configuration arranged to mate with the limb 14. For example, the first interlocking portion 38 can comprise a recess, groove, or notch cut into the first lateral surface 43. The first interlocking portion 38 can further comprise any suitably shaped protrusion or engagement mechanism suitable to engage the limb 14. For example, a protrusion can be semi-cylindrical, oblong, rectangular, or semi-spherical. Various recesses or cavities could also be used.

In some embodiments, the second lateral surface 44 comprises an interlocking portion 39. In some embodiments, the interlocking portion 39 comprises a protrusion extending inwardly away from the second lateral surface 44 and toward the first lateral surface 43. The interlocking portion 39 can also comprise any other suitable configuration. For example the interlocking portion 39 can comprise a recess, groove, or notch cut into the second lateral surface 44. The second interlocking portion 39 can further comprise any suitably shaped protrusion. For example, the protrusion can be semi-cylindrical, oblong, rectangular, or semi-spherical.

In some embodiments, the interlocking portions 38, 39 can be similarly shaped, for example being mirror images of one another. In some embodiments, the interlocking portions 38, 39 can be different from one another.

In some embodiments, the first bow limb 14 comprises a first limb interlocking portion 36 and a second limb interlocking portion 37. The first limb interlocking portion 36 is configured to engage the first interlocking portion 38 of the first lateral surface 43. The second limb interlocking portion 37 is configured to engage the second interlocking portion 39 of the second lateral surface 44. Desirably, the various interlocking portions engage one another and prevent movement of the limb 14 with respect to the limb retainer 40 in the limb 14 longitudinal direction.

In some embodiments, the first and second limb interlocking portions 36, 37 comprise recesses that are complimentary with the protrusion of the first and second interlocking portions 38, 39 of the first and second lateral surfaces 43, 44. In some embodiments, the first and second limb interlocking portions 36, 37 comprise protrusions that are complimentary with recesses of the first and second interlocking portions 38, 39. The first and second limb interlocking portions 36, 37 can comprise any suitable shape, for example a recess, groove, or notch. Moreover, the first and second limb interlocking portions can comprise a protrusion in any suitable configuration, for example, semi-circular, oblong, rectangular, or semi-spherical. In some embodiments, the limb interlocking portions 36, 37 extend from the compression surface to the tension surface 34 of the first limb 14, for example as shown in FIG. 2.

In some embodiments, the lateral surfaces 43, 44 can include curvature along one axis and be substantially straight in an orthogonal direction. For example, a lateral surface 43 can include curvature in a horizontal direction and be straight in a vertical direction. This allows a limb 14 to be easily inserted into the limb retainer 40.

The first limb pocket 45 can further comprise any suitable number of interlocking portions, for example between 1 and 8 and the limb 14 can further comprise any suitable number of limb interlocking portions, for example between 1 and 8.

In some embodiments, the abutting surface 24 engages at least a portion of the bow limb compression surface 32, providing support for the bow limb 14 when mounted in the first limb pocket 45. In some embodiments, the abutting surface 24 can be shaped to mate with the compression side of the limb 14 in a way similar to the interlocking portions 38, 39. For example, the abutting surface 24 can comprise a protrusion that mates with a groove in the compression surface of the limb 14, or vice versa.

The first and second interlocking portions 38, 39 prevent the first limb 14 from moving longitudinally out of the limb pocket 45, for example by counteracting forces applied at a distal end 56 of the bow limb 14. In some embodiments, interlocking portions 38, 39 are located along a proximal portion 46 of the limb retainer 40. In some embodiments (not shown), the interlocking portions 38, 39 are located at a distal portion 48 of the limb retainer 40 or in between the proximal portion 46 and the distal portion 48 of the limb retainer 40, or at any other suitable location.

In some embodiments, the limb retainer 40 comprises a raised surface 42 or a plurality of raised surfaces 42. As shown in FIG. 2, the raised surfaces 42 project from the first and second lateral surfaces 43, 44 of the limb pocket 45. The raised surface 42 is arranged to contact a portion of the limb lateral wall 50. In this way, the raised surface(s) 42 prevent the first limb 14 from moving laterally within the limb pocket 45 and provide support for the first limb 14 at a desired region on the first limb 14.

In some embodiments, the retaining assembly 30 comprises a fastener 52, such as a cap screw. In some embodiments, the fastener 52 can hold the first bow limb 14 in the limb pocket 45 and fasten the retaining assembly 30 to the bow handle. In some embodiments, the fastener 52 can be threadably engaged to a portion of the handle, for example to adjust draw weight.

In some embodiments, the retaining assembly 30 can comprise a pivot 54. The pivot 54 is configured to allow the limb retainer 40 to rotate about a pivot axis with respect to the riser 12, for example to change the bow draw weight. The retaining assembly 30 can further comprise a fastener 64 which can be threadably engaged with a portion of the limb retainer 40, the riser, or both. In some embodiments, a fastener 64 extends through the limb retainer 40 and engages the riser.

Turning now to FIG. 3, a top view of an embodiment of the limb retainer 40 is shown a proximal end of a first bow limb 14 in the limb retainer 40. In some embodiments, at least a portion of each of the limb lateral walls 50 contacts a raised surface 42, providing a gap 58 between a portion of the limb lateral wall 50 and a portion of the first and second lateral surfaces 43, 44. The raised surfaces 42 permit the limb 14 to be positively located on a desired region of the lateral walls 50 of the first limb 14. For example, as shown in FIG. 3 the raised surfaces 42 are positioned along the distal portion 48 of the limb retainer 40 to provide lateral stability for the first limb 14.

In some embodiments, the first limb 14 has a tapered proximal end 55, for example, as shown in FIG. 3. In some embodiments, the limb proximal end 55 can be provided without a taper. In some embodiments, the limb proximal end 55 is rounded, arcuate, or comprises any other suitable shape.

In some embodiments, a space 60 is defined between the proximal end 61 of the first bow limb 14 and the opposing wall 62 of the limb retainer 40. The space 60 permits clearance proximal end 61 of the first bow limb 14 and the opposing wall 62. In addition, the space 60 allows for proper alignment of the limb interlocking portions 36, 37 with the retainer interlocking portions 38, 39, as the proximal end 61 does not directly contact the opposing wall 62.

In some embodiments, a tapered configuration of the lateral surfaces 43, 44, and complimentary shape of the limb, allows for self-centering of the limb 14 with respect to the limb retainer 40 as the tapered limb 14 abuts the tapered lateral surfaces 43, 44. Further, in some embodiments, portions 66 of the first and second interlocking portions 38, 39 can provide a reverse taper configuration. While the tapered lateral surfaces 43, 44 of the limb retainer 40 provide a taper in the proximal direction of the limb 14, the reverse tapered portions 66 of the first and second interlocking portions 38, 39 provide a taper in the distal direction of the limb 14. Thus, forces acting to displace the limb 14 in the proximal direction can cause the limb to self-center via the tapered lateral surfaces 43, 44, and forces acting to displace the limb 14 in the distal direction can cause the limb to self-center via the reverse tapered portions 66 of the first and second interlocking portions 38, 39.

In some alternative embodiments, the proximal end 61 of the limb 14 contacts the opposing wall 62. In this way, there is no space 60.

In some embodiments, the limb 14 comprises an aperture 15, for example to receive a fastener 52 (see FIG. 2). In some embodiments, the limb 14 comprises a continuous structure that extends fully about the aperture 15.

Figure 4:
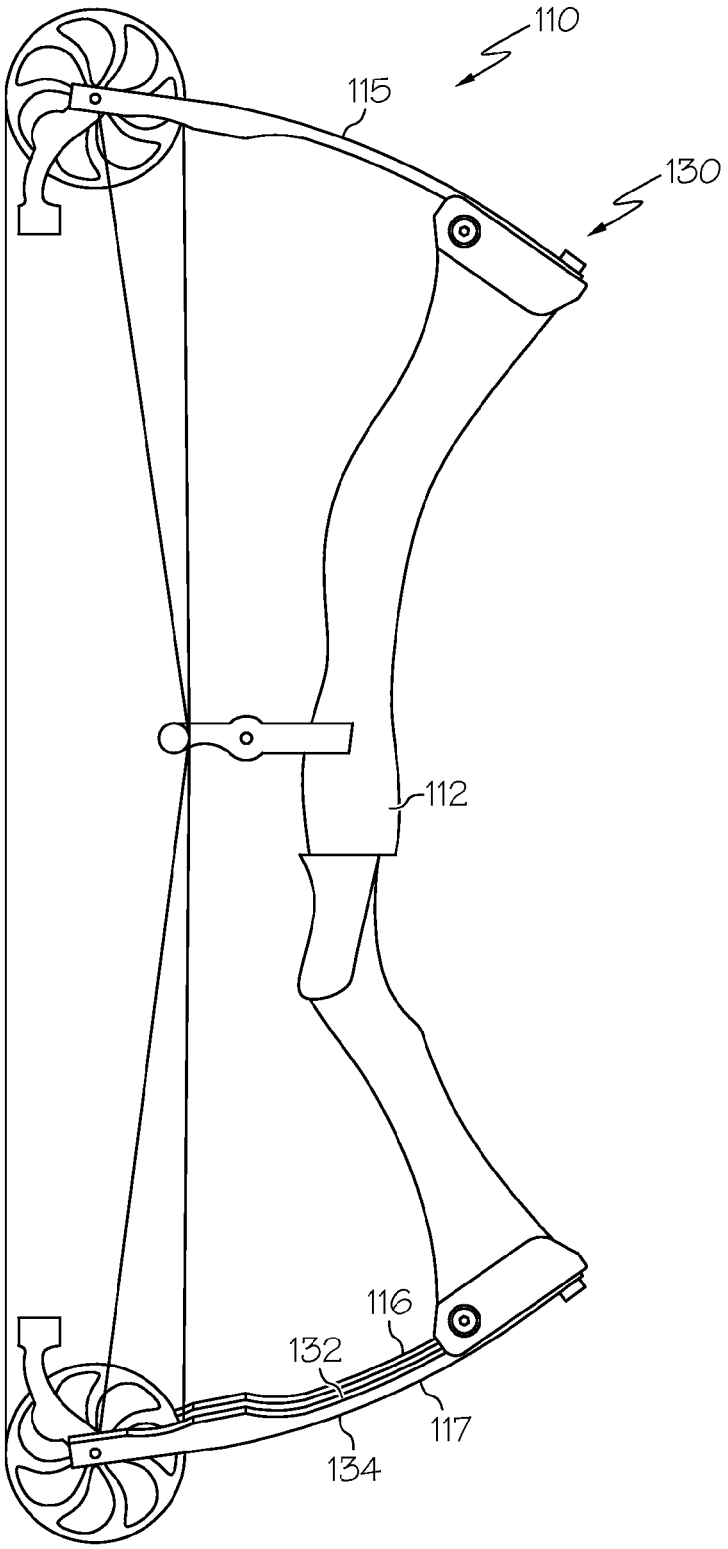
FIG. 4 shows another embodiment of an archery bow.

Turning to FIG. 4, an embodiment of an archery bow 110 is shown wherein multiple limb portions can be received by each limb retainer. The bow 110 comprises a limb retaining assembly 130, a handle 112, a third bow limb 115 and a fourth bow limb 117. The retaining assembly 130 retains a third limb 115 by securing the limb 115 to an end of the bow handle 112. The fourth bow limb 117 is shown with a compression surface 132 and a tension surface 134. The archery bow 110 is generally referred to as a split-limb bow, having a first limb 114 (FIG. 5) disposed adjacent to a third limb 115 and a second bow limb 116 disposed adjacent to a fourth bow limb 117. Although in some embodiments the archery bow 110 comprises a split-limb configuration, for example as shown in FIG. 4, various embodiments of the retaining assembly can be configured to work with a single limb (e.g., solid limb), while others are suited for split-limbs. Additionally, some embodiments of the retaining assembly can be configured to work with any suitable number of limbs.

Figure 5:
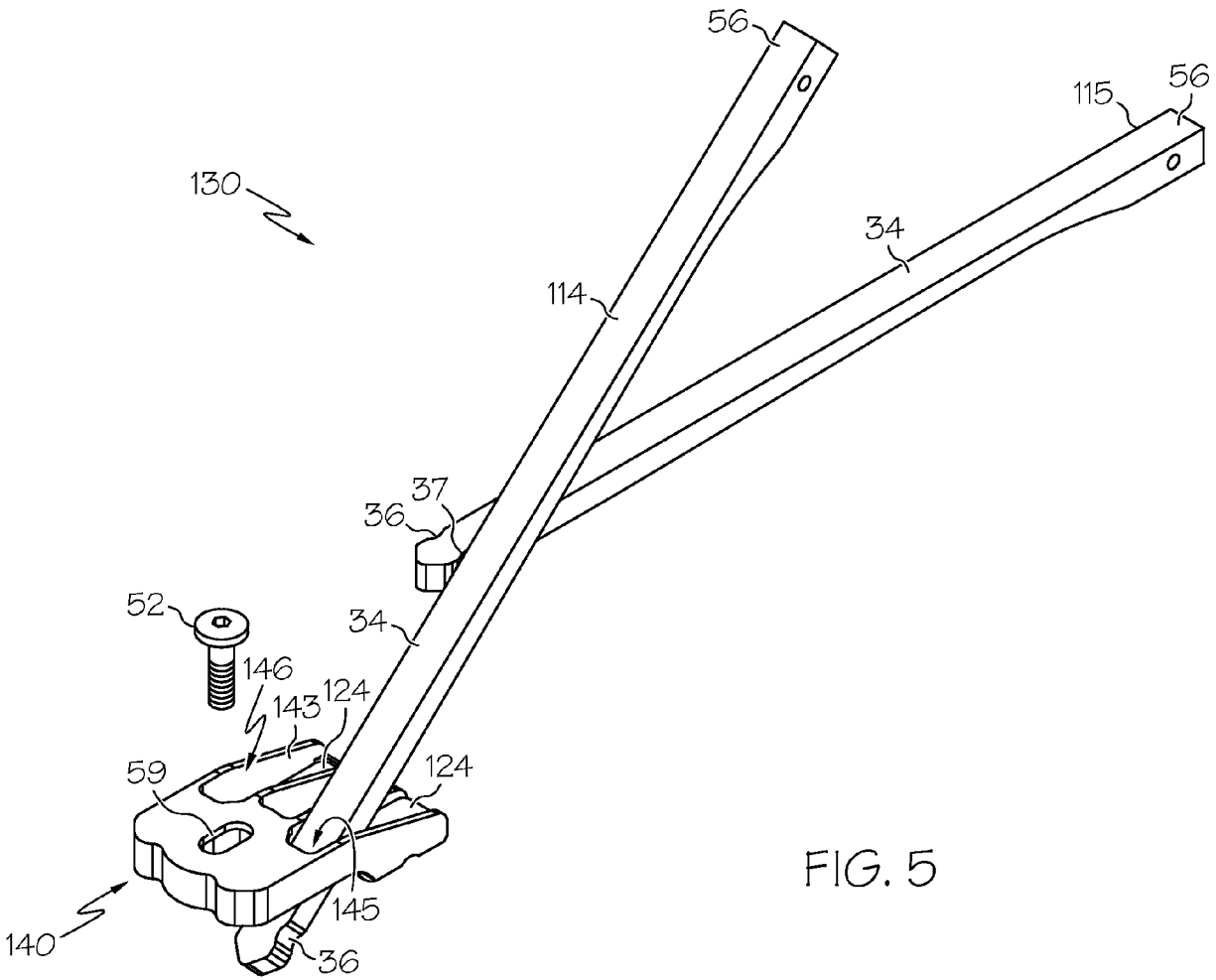
FIG. 5 shows an embodiment of an assembly comprising a limb retainer and a plurality of limbs.

Turning now to FIG. 5, an embodiment of the retaining assembly 130 is shown. In some embodiments, the retaining assembly 130 comprises a limb retainer 140. The limb retainer 140 comprises a first limb pocket 145 and a second limb pocket 146. In some embodiments, each limb pocket 145, 146 provided in the limb retainer 140 comprises the features described with respect to the limb pocket 45 described with respect to FIGS. 2 and 3.

Figure 6:
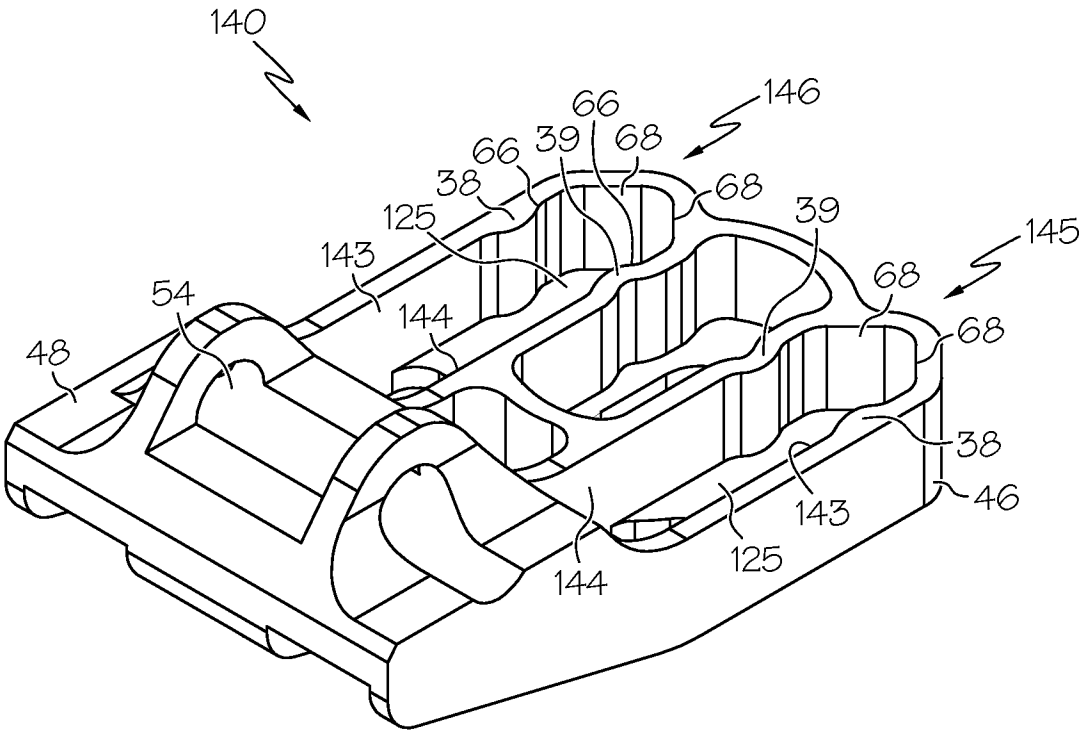
FIG. 6 shows another view of the limb retainer of FIG. 5.

In some embodiments, the first limb pocket 145 comprises a first lateral surface 143 and a second lateral surface 144 opposite the first lateral surface 143 (FIG. 6). The second limb pocket 146 comprises a first lateral surface 143 and a second lateral surface 144 opposite the first lateral surface 143.

In some embodiments, the first limb pocket further comprises a first abutting surface 124 and a second abutting surface 125. The first abutting surface 124 of the first limb pocket 145 adjoins at least a portion of the first and second lateral surfaces 143, 144. In some embodiments, the first and second lateral surfaces 143, 144 of the first limb pocket 145 are perpendicular to at least a portion of the first abutting surface 124. The second abutting surface 125 of the first limb pocket 145 adjoins at least a portion of the first and second lateral surfaces 143, 144. In some embodiments, the first and second lateral surfaces 143, 144 of the first limb pocket 145 are perpendicular to at least a portion of the second abutting surface 125.

In some embodiments, the second limb pocket 146 further comprises a first abutting surface 124 and a second abutting surface 125. The first abutting surface 124 of the second limb pocket 146 adjoins at least a portion of the first and second lateral surfaces 143, 144. In some embodiments, the first and second lateral surfaces 143, 144 of the second limb pocket 146 are perpendicular to at least a portion of the first abutting surface 124. The second abutting surface 125 of the second limb pocket 146 adjoins at least a portion of the first and second lateral surfaces 143, 144. In some embodiments, the first and second lateral surfaces 143, 144 of the second limb pocket 146 are perpendicular to at least a portion of the second abutting surface 125.

In some embodiments, the first and second lateral surfaces 143, 144 of the first limb pocket 145 comprise first and second interlocking portions 38, 39, respectively. In some embodiments, the first and second interlocking portions 38, 39 comprise protrusions each extending inwardly from the respective first and second lateral surfaces 143, 144. The first and second interlocking portions 38, 39 can comprise any other suitable configuration. For example, the first interlocking portion 38 can comprise a recess, groove, or notch cut into the first lateral surface 143. The second interlocking portion 39 can further comprise any suitably shaped protrusion. For example, the protrusion can be semi-cylindrical, oblong, rectangular, or semi-spherical. The interlocking portion 39 can also comprise any other suitable configuration. For example the interlocking portion 39 can comprise a recess, groove, or notch cut into the second lateral surface 144. The second interlocking portion 39 can further comprise any suitably shaped protrusion. For example, the protrusion can be semi-cylindrical, oblong, rectangular, or semi-spherical.

In some embodiments, the first bow limb 114 comprises a first limb interlocking portion 36 and a second limb interlocking portion 37 (FIG. 5). The first limb interlocking portion 36 is configured to engage the first interlocking portion 38 of the first lateral surface 143. The second limb interlocking portion 37 is configured to engage the second interlocking portion 39 of the second lateral surface 144.

In some embodiments, the first and second limb interlocking portions 36, 37 comprise recesses that are complimentary with the protrusion of the first and second interlocking portions 38, 39 of the first and second lateral surfaces 143, 144. In some embodiments, the first and second limb interlocking portions 36, 37 comprise protrusions that are complimentary with recesses of the first and second interlocking portions 38, 39. The first and second limb interlocking portions 36, 37 can comprise any suitable shape, for example a recess, groove, or notch. Moreover, the first and second limb interlocking portions can comprise a protrusion in any suitable configuration, for example, semi-circular, oblong, rectangular, or semi-spherical. In some embodiments, the limb interlocking portions 36, 37 extend from the compression surface to the tension surface 34 of the first limb 114.

In some embodiments, each limb pocket 145, 146 comprises tapered wall portions 68 that provide for self-centering of the limb 56 with respect to the pocket (e.g. 145). In some embodiments, the interlocking portions 38, 39 of each limb pocket 145, 146 can include reverse tapered portions 66 that provide for a reverse taper.

The first limb pocket 145 can further comprise any suitable number of interlocking portions, for example between 1 and 8 and the limb first 114 can further comprise any suitable number of limb interlocking portions, for example between 1 and 8.

In some embodiments, the first abutting surface 124 engages at least a portion of the bow limb compression surface 32, providing support for the bow limb 114 when mounted in the first limb pocket 145. In some embodiments, the second abutting surface 125 engages at least a portion of the bow limb tension surface 34. In some embodiments, the first abutting surface 124 is located distally with respect to the second abutting surface 125 (thus, the second abutting surface 125 is located proximally with respect to the first abutting surface 124). In some embodiments, the first abutting surface 124 and the second abutting surface 125 occupy separate length portions of the limb retainer 140, and are not coextensive.

In some embodiments, the limb retainer 130 does not comprise any structure positioned opposite the first abutting surface 124 (e.g. does not include any structure that would contact the tension side of the limb opposite the first abutting surface 124). Similarly, in some embodiments, the limb retainer 130 does not comprise any structure positioned opposite the second abutting surface 125 (e.g. does not include any structure that would contact the compression side of the limb opposite the second abutting surface 125).

The first and second interlocking portions 38, 39 of the first limb pocket 145 prevent the first limb 114 from moving longitudinally out of the limb retainer 140 by counteracting the force applied at a distal end 56 of the bow limb 114. In some embodiments, interlocking portions 38, 39 are located along a proximal portion 46 of the first limb pocket 145. In some embodiments (not shown), the interlocking portions 38, 39 are located at a distal portion 48 of the first limb pocket 145 or in between the proximal portion 46 and the distal portion 48 of the limb retainer 140, or at any other suitable location.

In some embodiments, the second limb pocket 146 can comprise any suitable number of interlocking portions, for example between 1 and 8 and the third bow limb 115 can further comprise any suitable number of limb interlocking portions, for example between 1 and 8.

In some embodiments, the first abutting surface 124 engages at least a portion of the bow limb compression surface 32, providing support for the third bow limb 115 when mounted in the second limb pocket 146. In some embodiments, the second abutting surface 125 engages at least a portion of the bow limb tension surface 34.

The first and second interlocking portions 38, 39 of the second limb pocket 146 prevent the third limb 115 from moving longitudinally out of the limb retainer 140 by counteracting the force applied at a distal end 56 of the third bow limb 115. In some embodiments, interlocking portions 38, 39 are located along a proximal portion 46 of the second limb pocket 146. In some embodiments (not shown), the interlocking portions 38, 39 are located at a distal portion 48 of the second limb pocket 146 or in between the proximal portion 46 and the distal portion 48 of the limb retainer 140, or at any other suitable location.

In some embodiments, for example as shown in FIGS. 5 and 6, the first abutting surface 124 is longitudinally offset from the second abutting surface 125 along the length of the limb retainer 140. In some embodiments, the first abutting surface 124 is distal to the second abutting surface 125, the second abutting surface 125 engaging a portion of the bow limb proximal to the first abutting surface 124.

In some embodiments, the abutting surfaces 124, 125 are arranged to support the limb 114 by applying forces that counteract forces applied to the distal end 56 of the limb, for example by a bowstring.

In some embodiments, the third bow limb 115 is paired with the first bow limb 114. In some embodiments, the first and third bow limbs 114, 115 can be interchangeable with one another. In some embodiments, the first slot 142 and the third slot 143 can be mirror images of one another.

In some embodiments, the retaining assembly 130 can define a hole 59 therethrough. The hole 59 can be disposed through a portion of the limb retainer 140 and can be circular, for example, or it can be oblong as shown in FIG. 5; the hole 59 can be configured in any suitable shape. A fastener 52 can be positioned in the hole 59 to engage a portion of the handle (not shown). For example, the fastener 52 can comprise a bolt threadably engaged with a portion of the handle (not shown), wherein the draw weight of the bow can be adjusted by turning the bolt in or out as desired.

The retaining assembly 130 can comprise a pivot 54. The pivot 54 permits the retaining assembly 130 to pivot on the bow handle (not shown), for example if the draw weight is changed.

As shown in FIGS. 5 and 6, the first limb 114 is prevented from moving longitudinally within in the limb pocket by engagement of the interlocking portions 38, 39 with the first and second limb interlocking portions 36, 37. The first limb 114 is further restrained by the first and second abutting surfaces 124, 125 which are configured to prevent the first limb 114 from moving relative to the first limb pocket as long as the bow is strung and the bowstring is in tension. Furthermore, the first limb 114 is restrained laterally by the first and second lateral surfaces 143, 144. In this way, the first limb 114 can be easily removed from the first limb pocket 145 of the limb retainer 140 without having to remove fastener 52. In order to remove the limb from the limb pocket, an archer or technician must first relieve the tension in the bowstrings, for example with a bow press as is known in the art. Then, the limb or limbs can simply be rotated and removed from the limb pocket or pockets, as explained below in greater detail and shown with respect to progressive steps of FIGS. 8-9.

Figure 7:
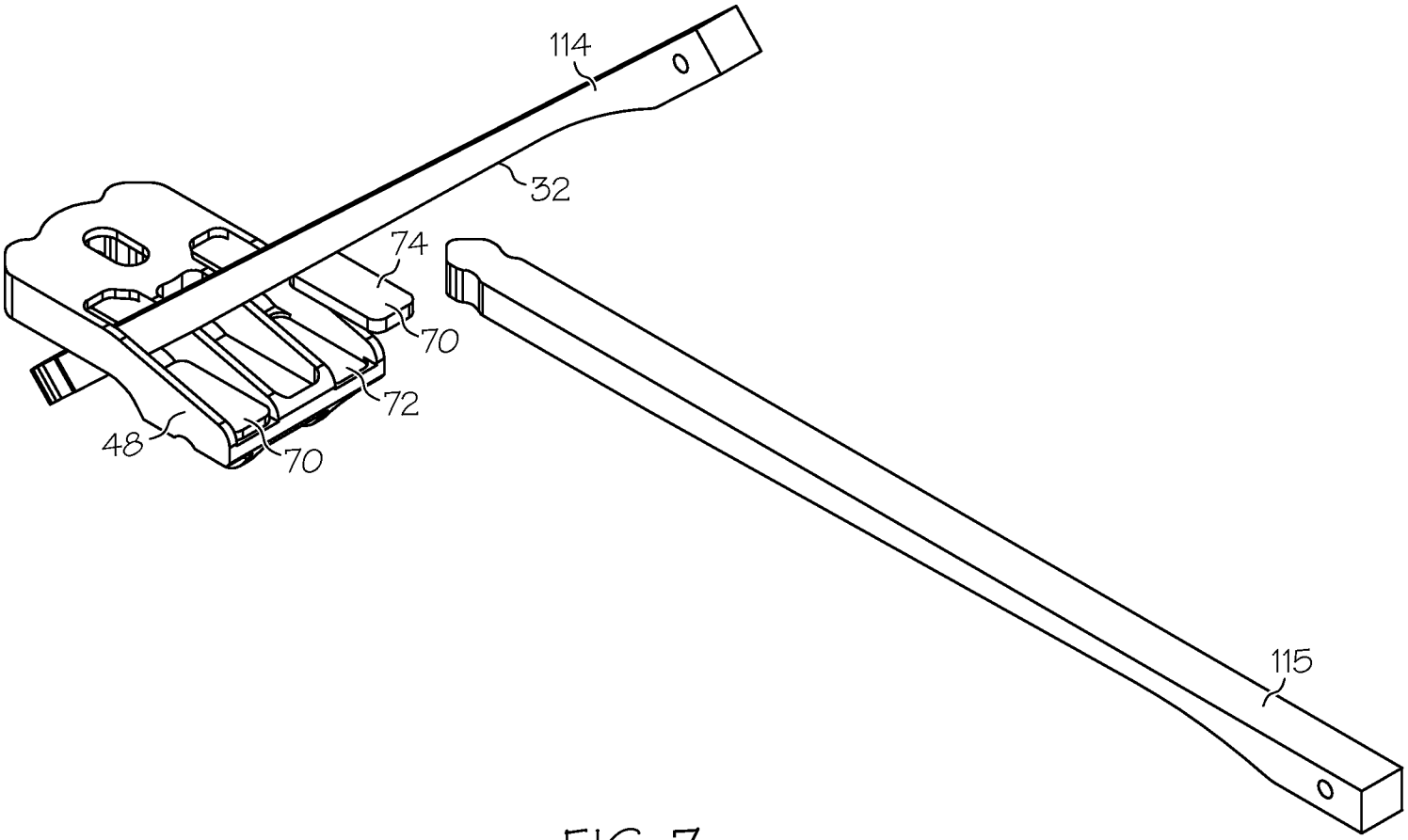
FIG. 7 shows another view of the assembly of FIG. 5.

As shown in FIG. 7, in some embodiments, the retaining assembly 130 can comprise a wear member 70. In some embodiments, the wear member 70 is disposed between the compression surface 32 of the bow limb 114, 115 and a distal portion 48 of the first and second limb pockets 145, 146. In some embodiments, the wear member 70 can comprise an insert disposed in the limb pocket.

The wear member 70 can have a wear surface 74. In some embodiments, the wear surface 74 is curved, for example as shown in FIG. 7. In some embodiments, the wear surface 74 has a convex shape, permitting a portion of the bow limb 114, 115 to smoothly translate across the wear surface 74 as the bow limb flexes, for example when the bow is drawn back. In some embodiments, the first retaining surface 74 is convex only along its length, but is substantially flat along its width. The wear surface 74 can be flat or substantially flat along its width and/or length. The wear surface can also comprise any other suitable shape.

The wear member 70 can be constructed from any suitable material, for example low friction materials such as Nylon and/or other various polymers.

In some embodiments, the limb pocket 145, 146 can comprise a recessed area 72. The recessed area 72 can be configured such that a portion of the wear member 70 is located in the recessed area 72. The recessed area 72 ensures that the wear member 70 is properly situated in the limb pocket 145, 146. In some embodiments, the recessed area 72 is made by machining or milling away material in the limb 145, 146. Other suitable methods can also be employed.

In some embodiments, the wear member 70 comprises an insert that is shaped to be inserted in the recessed area 72.

Figure 8:
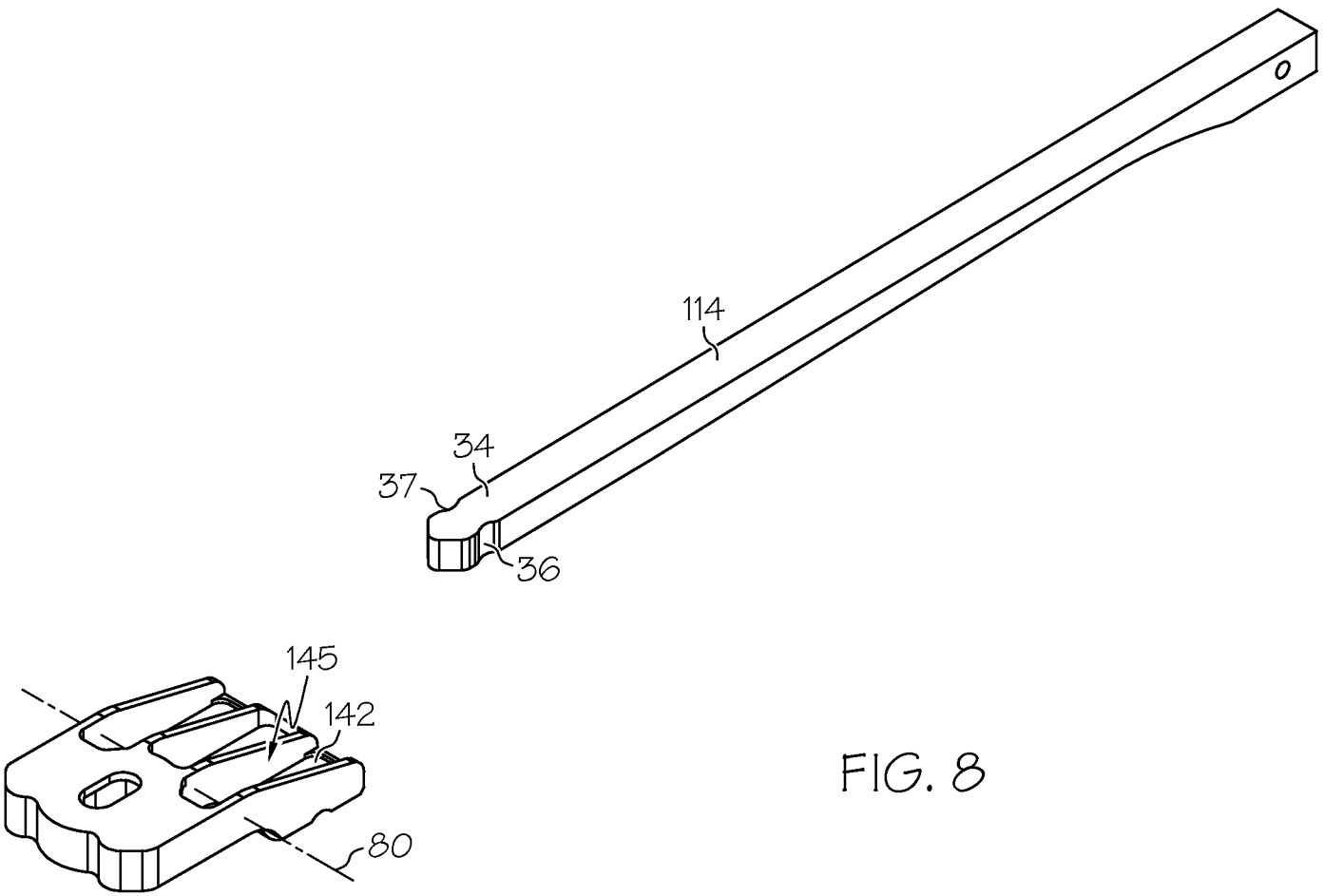
FIGS. 8-10 depict the assembly of FIG. 5 at various stages of assembly.
Figure 9:
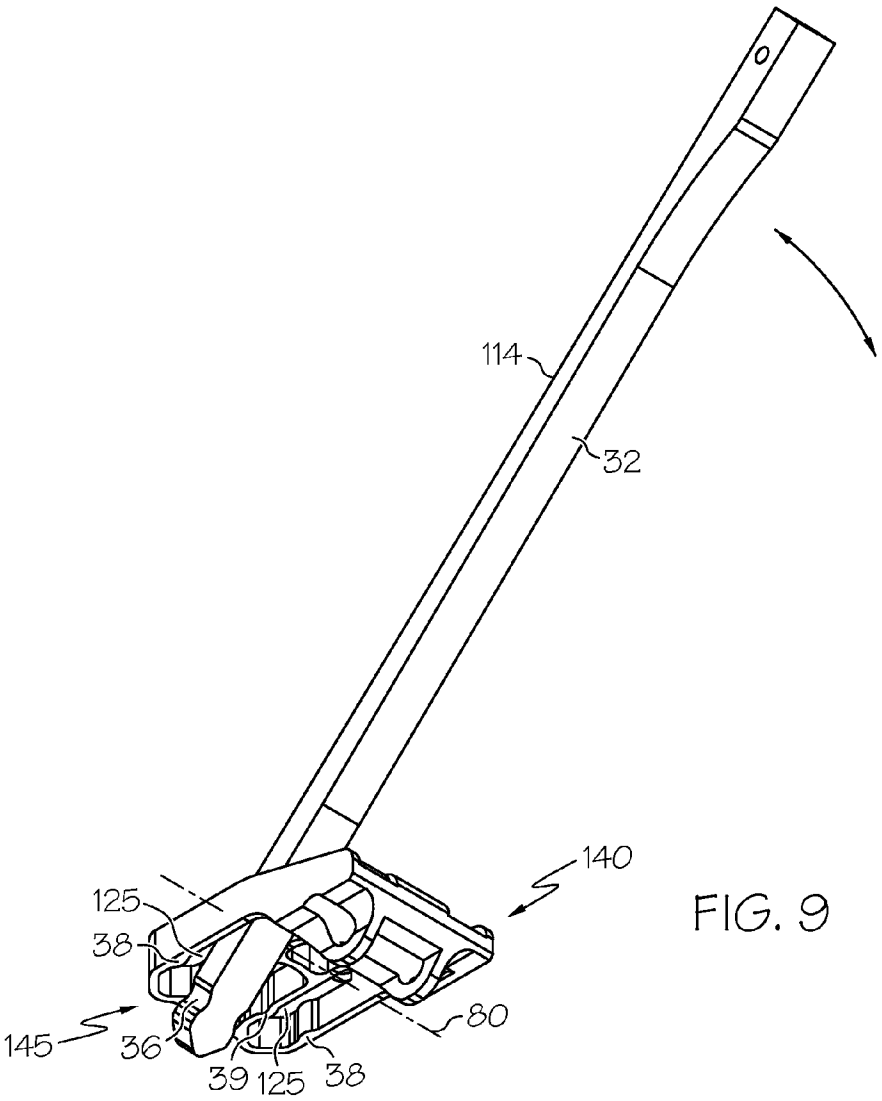

Turning to FIGS. 8 and 9, a method of inserting a first bow limb 114 in a retaining assembly 130 is shown. FIG. 8 shows a first bow limb 114 being aligned with a first limb pocket 145 such that the length of the bow limb 114 is perpendicular to axis 80. In some embodiments, axis 80 extends through the retainer 140 parallel to the first abutting surface 124.

As shown in FIG. 9, the first limb 114 is inserted into the retainer 140. More specifically, the first limb 114 is inserted into the first limb pocket 145. The first limb 114 is then rotated about the axis 80 until the compression surface 32 contacts the first abutting surface 124 (FIG. 8), the tension surface 34 contacts the second abutting surface 125 and the first and second retainer interlocking portions 38, 39 matingly engage the first and second limb interlocking portions 36, 37, respectively.

Figure 10:
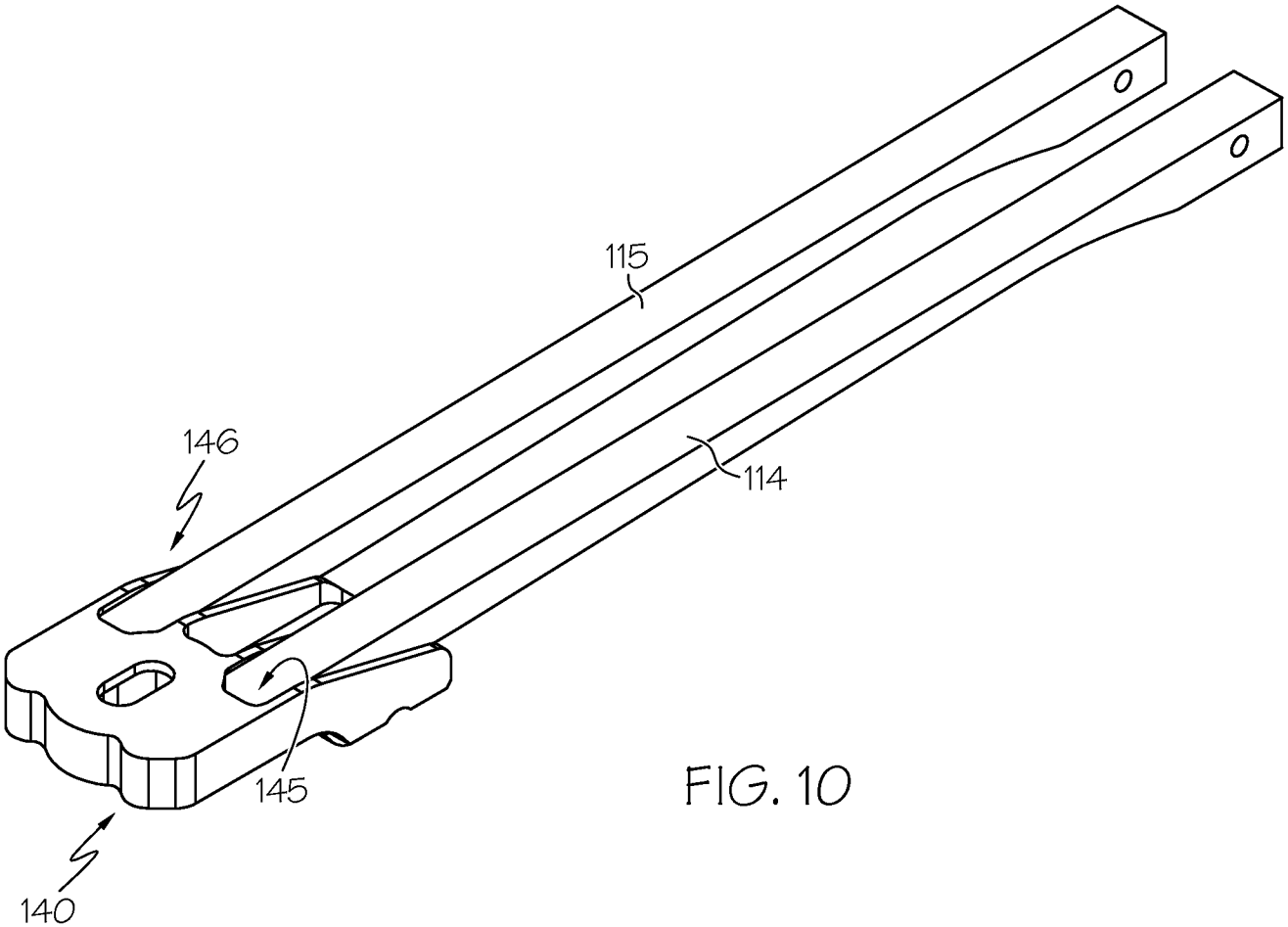

FIG. 10 shows the first and third bow limbs 114, 115 residing in the first and second limb pockets 145, 146 of the retainer 140.

These steps can be repeated for inserting a third bow limb in a similar fashion. Furthermore, the steps can be repeated with a second limb retainer and second and fourth bow limbs. In addition, where the limb retainer is configured to accept more than two limbs, the steps can be repeated for each additional limb.

Although not explicitly shown, in some embodiments the retaining assembly can comprise a limb pocket having first and second abutting surfaces for contacting respective compression and tension sides and retaining a single limb or solid-limb, as opposed to the split limb configuration shown in FIGS. 5 and 6. Thus, the limb may be inserted according to the method disclosed above, and a second limb may be similarly inserted in a second limb retainer on the opposite end of the handle.

Any feature disclosed with respect to any particular embodiment of a limb and/or limb retainer disclosed herein can be combined with any other suitable embodiment of a limb and/or limb retainer.

In some embodiments, an abutting surface 124 engages at least a portion of the bow limb compression surface 32, providing support for the bow limb 14 when mounted in the first limb pocket 45. In some embodiments, the abutting surface 124 can be shaped to mate with the compression side of the limb 14 in a way similar to the interlocking portions 38, 39. For example, the abutting surface 124 can comprise a protrusion that mates with a groove in the compression surface of the limb 14, or vice versa. Similarly, an abutting surface 125 can be shaped to mate with the tension side of the limb 14 in a way similar to the interlocking portions 38, 39. For example, the abutting surface 125 can comprise a protrusion that mates with a groove in the tension surface of the limb 14, or vice versa.

In some embodiments, an abutting surface 125 can be shaped to mate with another object or device that is arranged to engage a limb 14. For example, referring to FIG. 2, a limb 14 and fastener 52 can be provided, and the fastener 52 can be disposed through the limb 14. A limb retainer can comprise an abutting surface 125 (see e.g. FIG. 9) that is shaped to receive a portion of the fastener 52, for example having a cavity shaped to mate with the fastener 52 head.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A bow limb retaining assembly comprising:

a first limb pocket comprising a first lateral surface and a second lateral surface, said first lateral surface comprising a pocket interlocking portion, said pocket interlocking portion comprising a protrusion or a recess; and a first bow limb having a tension surface, a compression surface and first and second outer sides, said first outer side comprising a limb interlocking portion;

wherein said pocket interlocking portion is configured to matingly engage said limb interlocking portion.

2. The bow limb retaining assembly of claim 1, wherein said pocket interlocking portion comprises a protrusion and said limb interlocking portion comprises a recess.

3. The bow limb retaining assembly of claim 1, wherein said pocket interlocking portion comprises a recess and said limb interlocking portion comprises a protrusion.

4. The bow limb retaining assembly of claim 1, wherein said first lateral surface and said second lateral surface are non-parallel.

5. The bow limb retaining assembly of claim 1, said second lateral surface comprising a second pocket interlocking portion, said second outer side comprising a second limb interlocking portion.

6. The bow limb retaining assembly of claim 5, wherein said second pocket interlocking portion comprises a protrusion and said second limb interlocking portion comprises a recess.

7. The bow limb retaining assembly of claim 1, further comprising a second limb pocket and a second bow limb, said second limb pocket comprising a first lateral surface and a second lateral surface, said second lateral surface of said second limb pocket comprising a pocket interlocking portion, said second bow limb having a tension surface, a compression surface and first and second outer sides, said second outer side of said second bow limb comprising a limb interlocking portion.

8. The bow limb retaining assembly of claim 7, wherein said pocket interlocking portion of said second limb pocket comprises a protrusion and said limb interlocking portion of said second bow limb comprises a recess.

9. The bow limb retaining assembly of claim 1, wherein said first limb pocket further comprises a first abutting surface and a second abutting surface, said first abutting surface contacting said compression surface and said second abutting surface contacting said tension surface.

10. A bow limb retaining assembly comprising:

a first limb pocket comprising a first lateral surface and a second lateral surface, said first lateral surface comprising a protrusion; and a bow limb having a tension surface, a compression surface and first and second outer sides, said first outer side comprising a recess;

wherein at least a portion of said protrusion is oriented in said recess.

11. The bow limb retaining assembly of claim 10, said second lateral surface comprising a second protrusion, said second outer side comprising a second recess, at least a portion of said second protrusion oriented in said second recess.

12. The bow limb retaining assembly of claim 10, wherein said first limb pocket further comprises a first abutting surface and a second abutting surface, said first abutting surface contacting said compression surface and said second abutting surface contacting said tension surface.

13. The bow limb retaining assembly of claim 10, further comprising a second limb pocket and a second bow limb, said second limb pocket comprising a first lateral surface and a second lateral surface, said second lateral surface of said second limb pocket comprising a protrusion, said second bow limb having a tension surface, a compression surface and first and second outer sides, said second outer side comprising a recess, at least a portion of said protrusion of said second limb pocket oriented in said recess of said second bow limb.

14. A bow limb retaining assembly comprising:

a first limb pocket comprising a first lateral surface and a second lateral surface, said first lateral surface comprising a protrusion; and a bow limb having a tension surface, a compression surface, a first outer side and a second outer side, said protrusion contacting said first outer side.

15. The bow limb retaining assembly of claim 14, said first outer side comprising a recess.

16. The bow limb retaining assembly of claim 15, wherein at least a portion of said protrusion is oriented in said recess.

17. The bow limb retaining assembly of claim 14, further comprising a second limb pocket and a second bow limb, said second limb pocket comprising a first lateral surface and a second lateral surface, said second lateral surface of said second limb pocket comprising a protrusion, said second bow limb having a tension surface, a compression surface and first and second outer sides, said protrusion of said second limb pocket contacting said second outer side of said second bow limb.

18. The bow limb retaining assembly of claim 17, said second outer side of said second bow limb comprising a recess.

19. The bow limb retaining assembly of claim 18, wherein at least a portion of said protrusion of said second limb pocket is oriented in said recess of said second bow limb.

20. The bow limb retaining assembly of claim 14, wherein said first limb pocket further comprises a first abutting surface and a second abutting surface, said first abutting surface contacting said compression surface and said second abutting surface contacting said tension surface.

* * * * *